US006106021A

United States Patent [19]

Phillips

[11] Patent Number: 6,106,021

[45] **Date of Patent: *Aug. 22, 2000**

[54] SECURITY PAPERS WITH UNIQUE RELIEF PATTERN

[75] Inventor: George K. Phillips, Paso Robles, Calif.

[73] Assignee: Verify First Technologies, Inc., Paso Robles, Calif.

[ * ] Notice: This patent is subject to a terminal disclaimer.

[21] Appl. No.: 09/017,041

[22] Filed: Feb. 2, 1998

[51] Int. Cl.[7] ..... B42D 15/00

[52] U.S. Cl. ..... 283/67; 283/59; 283/95; 283/96; 283/113; 428/211

[58] Field of Search ..... 283/58, 59, 95, 283/96, 113, 67; 428/211

[56] References Cited

U.S. PATENT DOCUMENTS

| | | | |
|---|---|---|---|
| 3,965,856 | 6/1976 | Scholl et al. | 118/202 |
| 4,457,585 | 7/1984 | DuCorday | 350/235 |
| 4,556,447 | 12/1985 | Bradley et al. | 156/578 |
| 4,863,783 | 9/1989 | Milton | 428/211 |
| 5,344,192 | 9/1994 | Phillips . | |
| 5,494,520 | 2/1996 | Lamendola et al. | 118/608 |
| 5,695,220 | 12/1997 | Phillips . | |
| 5,704,651 | 1/1998 | Phillips . | |
| 5,723,168 | 3/1998 | Swain et al. | 427/11 |
| 5,762,378 | 6/1998 | Phillips | 283/72 |
| 5,772,248 | 6/1998 | Phillips . | |
| 5,826,916 | 10/1998 | Phillips . | |
| 5,873,604 | 2/1999 | Phillips | 283/70 |

FOREIGN PATENT DOCUMENTS

WO 94/22676 10/1994 WIPO .

OTHER PUBLICATIONS

Scaman, Steven S., Lex, Elizabeth A., *FLEXO,* Dec., 1994, pp. 14, 16 & 17.

*Primary Examiner*—Willmon Fridie, Jr.
*Assistant Examiner*—Monica Smith Carter
*Attorney, Agent, or Firm*—Lyon & Lyon LLP

[57] ABSTRACT

A counterfeit-resistant document comprises a validation mark with relief markings according to a unique pattern that identifies the source of the document. The source of the document can be identified by detecting the unique pattern on the validation mark of the document, thus verifying the authenticity of the document. The validation mark further comprises a unique chemical signature that identifies the source of the document. The source of the document can be identified by detecting the unique chemical signature on the validation mark of the document, thus further verifying the authenticity of the document.

28 Claims, 8 Drawing Sheets

SECURITY PAPERS WITH UNIQUE RELIEF PATTERN

FIELD OF THE INVENTION

The present invention pertains to the field security systems for documents, including more particularly to novel methods of creating documents.

BACKGROUND

Presently known approaches for preventing duplication or counterfeiting of documents have focussed on printing information on original documents using specially designed inks or materials; camouflaging validation information in background patterns; or producing relief patterns on the document in the form of embossed characters. These methods generally allow the information to be viewed in some special manner on the original, but due to the unique color, texture, or reflective properties of the material, or relief structure, do not allow the information to be readily discernible on a photocopy or duplicate of the original.

These techniques may generally provide protection from the unauthorized duplication or counterfeiting of valuable documents, but the security measures that are effected through the practice of these techniques may still, however, be circumvented by unscrupulous copyists and counterfeiters who are familiar with these techniques and possess machinery to circumvent these measures. Thus, those who seek the protection provided by these techniques may still be vulnerable to some extent.

There thus remains a need to provide a counterfeit proof and copy proof original document and a technique for validating a document that is unique to the document and/or source who seeks the security measures provided by this technique, so that the chance of successful duplication or counterfeiting of the document is further minimized.

SUMMARY OF THE INVENTION

The present inventions comprises a novel method for physically imprinting a unique signature on a document, which is detectable to verify the authenticity of the document.

In a preferred method and embodiment of the present inventions, relief markings are formed on a document according to the unique pattern forming a validation mark thereon. The authenticity of the document is verified by detecting the unique pattern formed by the relief markings.

In another preferred method and embodiment of the present inventions, relief markings are formed on a document according to the unique pattern forming a validation mark thereon. A unique chemical signature comprising a unique chemical identifying agent and/or a unique molecular code is also applied to the document. The authenticity of the document can be verified by detecting the unique pattern formed by the relief markings. The authenticity of the document can be further verified by detecting the unique chemical identifying agent through means such as the application of a complementary chemical activator, and by detecting the unique molecular code through means such as spectrographic or forensic analysis.

BRIEF DESCRIPTION OF THE DRAWINGS

The various objects, features and advantages of the present invention may be better understood by examining the Detailed Description of the Drawings below, together with the appended figures, wherein.

DETAILED DESCRIPTION OF THE PREFERRED EMBODIMENTS

It is anticipated that the present invention is particularly suitable in situations where it is desirable to verify the source of valuable documents, such as, e.g., stocks or bonds that are capable of being verified by the corporation or governmental agency after redemption thereof, or even currency that can be verified by a banking institution or a governmental agency. The present invention, however, is not limited to these applications and can be used in any application in which it is desirable to be able to discern an original from an alteration or reproduction. Co-pending application Ser. No. 09/017,551 is filed concurrently herewith, which is fully incorporated herein by reference.

Figure 1:
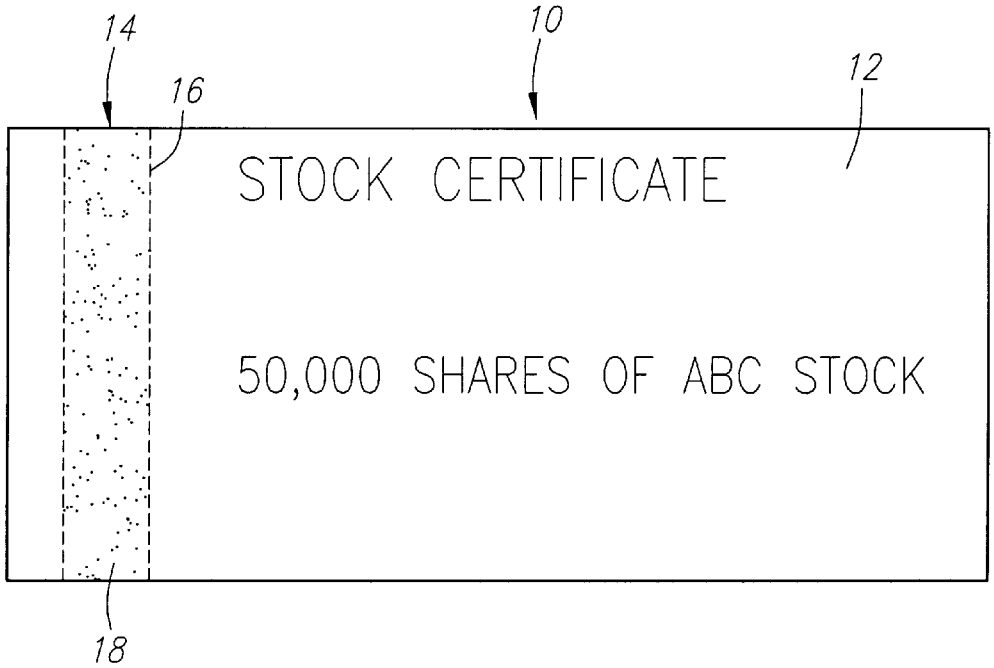
FIG. 1 is a top view of a counterfeit-resistant document according to a preferred embodiment of the present invention.

FIG. 1 depicts a counterfeit-resistant document 10 comprising a substrate 12 and a validation mark 14 according to a preferred embodiment of the present invention. The substrate 12 is preferably of paper stock. Any material suitable for printing, however, may be used without departing from the scope of the present invention.

The validation mark 14 comprises a unique chemical signature that comprises a unique chemical identifying agent and a unique molecular code. Preferably, the unique chemical identifying agent and unique molecular code are combined as a unique chemical concentrate in a mixture of isopropyl alcohol and distilled water to form a clear covert unique chemical solution 24, shown as being applied in FIG. 2. The ratio of the water/alcohol solution to the unique chemical concentrate varies with the strength of the unique chemical concentrate. In general, the greater the strength of the unique chemical concentrate, the greater the ratio of the water/alcohol solution to the unique chemical concentrate. By way of example, a typical ratio of the water/alcohol solution to the unique chemical concentrate is 25:1. The proportion of water to isopropyl alcohol is preferably approximately 5:1.

In alternative embodiments, Ultra Violet (UV) dye is added to the unique chemical solution 24 to further enhance the security provided by the validation mark 14, as will be described in further detail below. The proportion of distilled water to UV dye is typically approximately 4:1.

Figure 2:
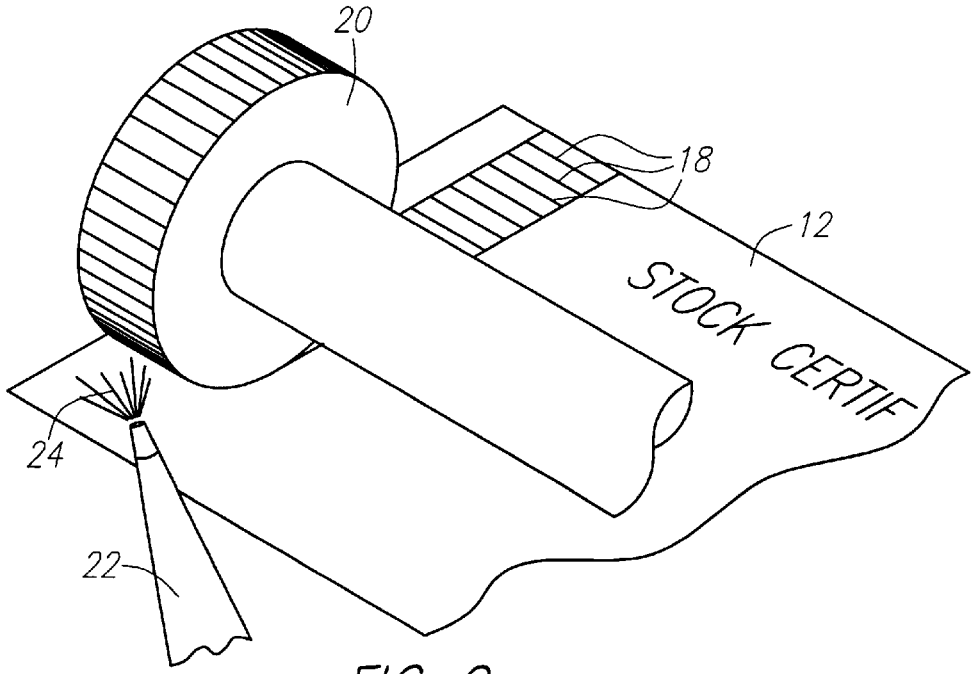
FIG. 2 is a perspective view depicting a preferred method of forming a validation mark on the document of FIG. 1.
Figure 3:
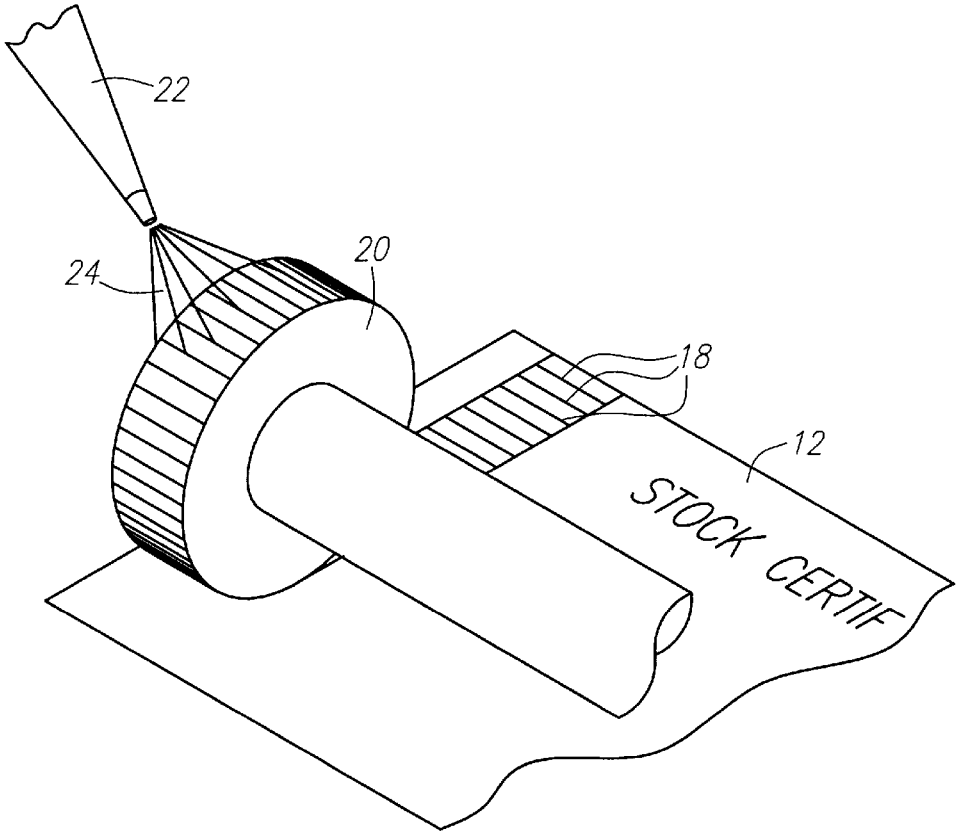
FIG. 3 is a perspective view of an alternatively preferred method of forming the validation mark on the document of FIG. 1.

The unique chemical solution 24 is applied to the surface of the substrate 12 in the form of a coating 16. Before the coating 16 cures, an embossing or debossing process is utilized to form relief markings 18 on the surface of the substrate 12 as depicted in FIGS. 2 and 3. The relief markings 18 break down the surface of the substrate 12 to aid the unique chemical solution 24 in penetrating the surface of the substrate 12 minimizing the amount of the unique chemical concentrate necessary to allow detection thereof.

As depicted in FIG. 2, a hardened application device, such as a pattern wheel 20, is employed to form the relief markings 18 on the substrate 12. The application of the standard pattern wheel 20 with sufficient pressure on the surface of the substrate 12 causes the relief markings 18 to form on the substrate 12. A sprayer 22 is employed to apply a conservative amount of the unique chemical solution 24 on the substrate 12 prior to the formation of the relief markings 18 on the substrate 12. Alternatively, as shown in FIG. 3, the sprayer 22 applies the unique chemical solution 24 on the standard pattern wheel 20, so that the unique chemical solution 24 simultaneously penetrates the surface of the substrate 12 as the relief markings 18 are formed thereon.

Figure 4:
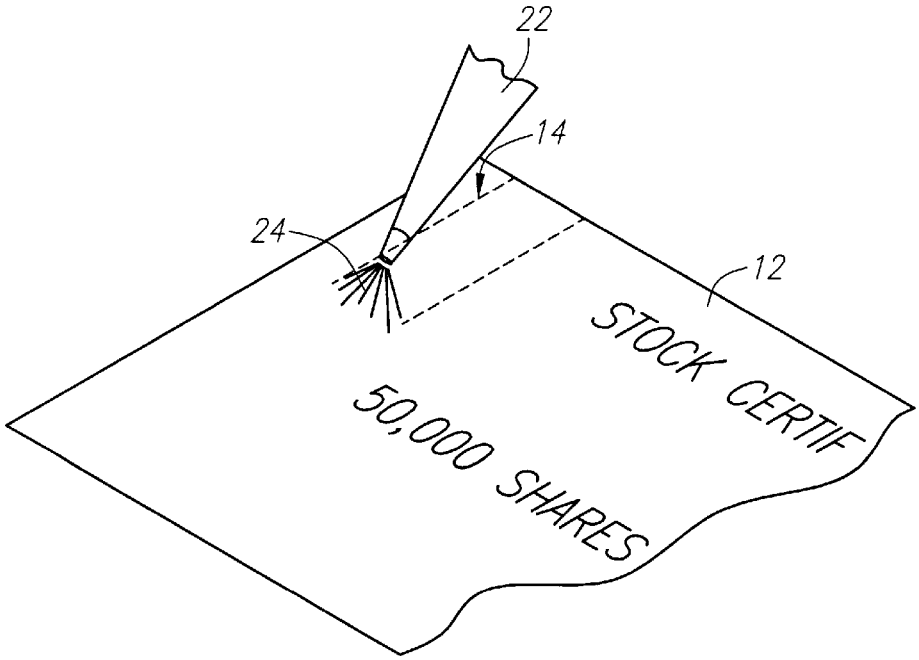
FIG. 4 is a perspective view of an alternatively preferred method of forming the validation mark on the document of FIG. 1.

As shown in FIG. 4, the embossing or debossing process is foregone, and the validation mark 14 is formed by flood coating the unique chemical solution 24 onto the substrate 12 with the sprayer 22. In general, however, if the unique chemical solution 24 is flood coated onto the substrate 12 without forcing the solution into the substrate 12, the ratio of the water/alcohol solution to the unique chemical concentrate is less than, or the amount of unique chemical solution 24 applied to the substrate 12 is greater than if the unique chemical solution 24 is forced into the substrate 12, such as with the pattern wheel 20 described above.

The chemical signature is unique to the source of the document 10, such as, e.g. in this case, the ABC Company. The unique chemical signature is a precise formulation that is selected by and unique to the source, such that detection of the unique chemical signature on the document 10 allows for identification of the source and resulting verification of the document's authenticity. The uniqueness of the chemical signature arises from the specific chemical identifying agent and specific molecular code found therein. Alternatively, the chemical signature is also unique to a particular type of document 10, such as, e.g. in this case, a stock certificate issued by the ABC company, allowing identification of the particular type of document 10 as well as the source of the document 10. More alternatively, the chemical solution 24 is unique to the printing or issue date of the document 10, manufacturer of the document 10, or any other aspect of the document 10.

The unique chemical identifying agent in the unique chemical solution 24 on the document 10 is detected in the field as follows. The unique chemical identifying agent is matched with a complementary chemical activator, which when combined, create a specific chemical transformation, such as, e.g., a chromatic change in the unique chemical identifying agent. In alternative preferred embodiments, the unique chemical solution 24 comprises multiple unique chemical identifying agents that activate differently when combined with respective complementary chemical activators. The complementary chemical activator is preferably combined as a concentrate in distilled water to form a complementary activating solution 28.

Figure 5:
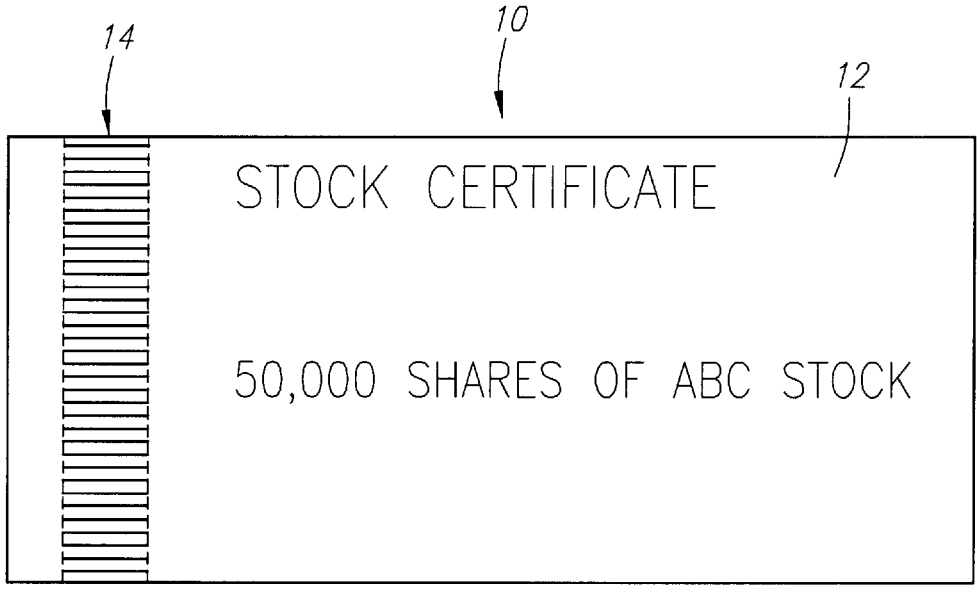
FIG. 5 is a top view depicting a document comprising the validation mark of FIG. 1 prior to detection of a unique chemical molecular code on the validation mark of the document of FIG. 1.
Figure 6:
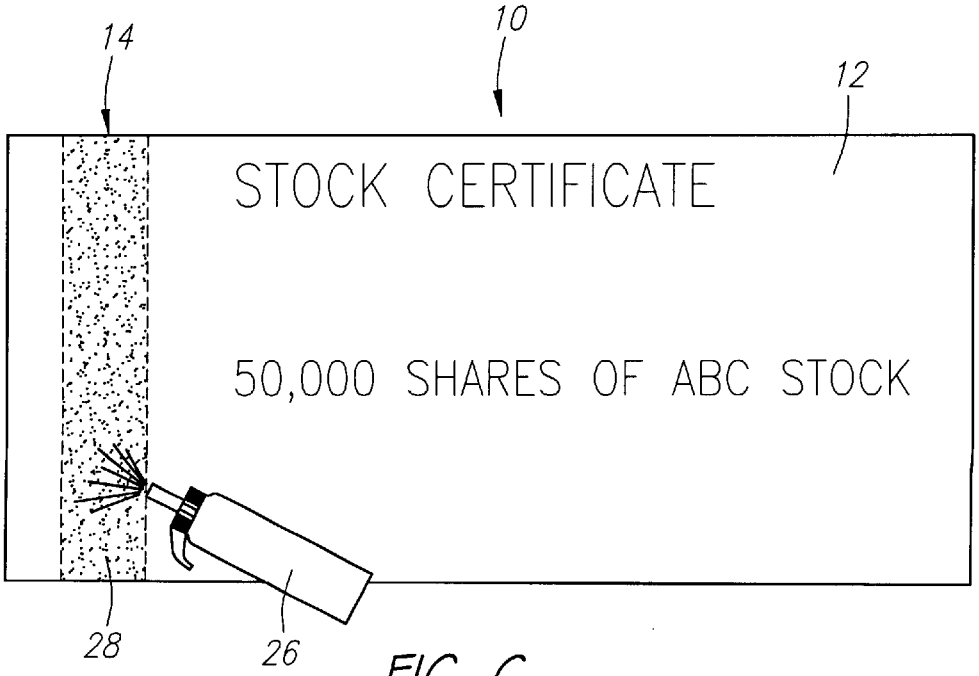
FIG. 6 is a top view depicting a preferred method of detecting a unique chemical molecular code on the validation mark of the document of FIG. 1.

As depicted in FIGS. 5 and 6, the presence of the unique chemical identifying agent of the unique chemical solution 24 on the document 10 is visually detected by applying the complementary activating solution 28 to the validation mark 14, such as by, e.g., spraying with a spray bottle 26. The combination of the complementary activating agent with the unique chemical identifying agent creates a chemical reaction, i.e., the validation mark 14 undergoes a chromatic transformation that alters the validation mark 14 as shown in FIG. 5 to that shown in FIG. 6, a transformation which can easily be recognized by the unaided human eye. If the unique chemical solution 24 comprises multiple unique chemical identifying agents, application of the complementary activating solution 28 comprising of respective complementary chemical activators creates different chemical reactions or chromatic transformations.

The unique molecular code in the unique chemical solution 24 on the document 10 is detected spectrographically. A resulting measured spectrographic composition that matches a known spectral signature profile of the unique molecular code confirms the document as the original and valid document 10. Alternatively, the unique molecular code is detected by sending the document to a forensic laboratory to determine the precise molecular code on the document 10.

The UV dye, if added to the unique chemical solution 24 as described above, is detected by exposing the document 10 to ultraviolet light so that the UV dye visually appears underneath the ultraviolet light.

The present invention of the document 10 is preferably practiced as follows. A unique chemical signature, i.e., a unique molecular code and a unique chemical identifying agent, which identify the source of a document 10 and/or, if applicable, other aspects of the document 10, are selected, combined in a unique chemical solution 24, and applied to the document 10 in the manner described above to form the validation mark 14 thereon. The document 10 is then distributed in the normal course of business, such as, e.g, to shareholders if the document 10 is a stock certificate, to bondholders if the document 10 is a bond, or to banks and the general public if the document 10 is currency. When the source of the document 10 comes into possession of an unverified document that has been circulated through the normal course of business and that the source anticipates as being an original and valid document 10, such as in the case of the redemption of stocks or bonds, the authenticity of that unverified document is verified as follows.

The unverified document is verified by employing a two-tiered process. At the first tier, the complementary activating solution 28 is sprayed on the area of the unverified document where the validation mark 14 is expected to be located. If the known chromatic transformation does not visually expose the validation mark, the unverified document is confirmed as a counterfeit or replication of the original and valid document 10, and no further analysis of the bogus document is necessary. If the known chromatic transformation visually exposes the validation mark 14 as described above, the authenticity of the unverified document is partially verified. The partially verified document can be fully verified by detecting the unique molecular code on the partially verified document at the second tier.

At the second tier, a spectrographic analysis is performed on the area of the partially verified document where the validation mark 14 is expected to be located. A resulting measured spectrographic composition that matches a known spectral signature profile of the unique molecular code confirms the partially verified document as the original and valid document 10. Conversely, a resulting measured spectrographic composition that does not match the known spectral signature profile of the anticipated molecular code confirms the partially verified document as a counterfeit or replication of the original and valid document 10.

Alternatively, at the second tier, the partially verified document is sent to a forensic laboratory to determine the precise chemical composition of any existing chemical substances on the area of the document where the validation mark 14 is expected to be located. A determination of a precise chemical composition on the partially verified document that matches the expected molecular code confirms the partially verified document as the original and valid document 10. Conversely, a determination of either the lack of a chemical composition or a precise chemical composition that does not match the expected molecular code confirms the partially verified document as a counterfeit or replication of the original and valid document 10.

If UV dye is added to the unique chemical solution 24, the authenticity of an unverified document is verified through a three-tiered process as follows. At the first tier, the authenticity of a document anticipated to be the original and valid document 10 is exposed to ultraviolet light. If the validation mark 14 does not visually appear under the ultraviolet light, the unverified document is confirmed as a counterfeit or replication of the original and valid document 10, and no further analysis of the bogus document is necessary. If the validation mark 14 visually appears, the authenticity of the unverified document is partially verified. The partially verified document can be fully verified, as described above with respect to the document 10, by applying the complementary activating solution 28 to the partially verified document at the second tier, and spectrographically or forensically analyzing the partially verified document at the third tier.

It is to be understood that the present invention is not limited to the afore-described authentication process. For instance, the unique chemical identifying agent detection process and the unique molecular code detection process can be combined into one tier to provide uncontroverted evidence that a document is bogus to, e.g., support a criminal case of fraud or counterfeiting against the purported culprit.

Or a four-tiered verification process can be used by sequentially exposing the document to UV light at the first tier, spraying the document with the complementary activating solution 28 at the second tier, spectrographically analyzing the document at the third tier, and then forensically analyzing the document at the fourth tier to fully verify the authentication of an unverified document. Or the authenticity of the document can be fully verified merely by spraying the document with the complementary activating solution 28. Any of the techniques described above can be foregone or combined with the other techniques in any manner that satisfies the particular user's security needs.

In alternative embodiments, the unique chemical signature does not comprise both the unique chemical identifying agent and the unique molecular code, but rather comprises one or the other, so that the authentication of the document 10 is fully verified by either applying the complementary activating solution 28 on the document 10, or spectrographically or forensically analyzing the document 10.

To facilitate the practice of the present invention, no person possesses knowledge of both the specific composition of the unique chemical concentrate to be applied to the document 10, and the identity of the end user, i.e., the source of the document 10. This anonymity can be accomplished, because the manufacturer of the document 10 need not know the precise composition of the unique chemical concentrate to apply it to the document 10 in accordance with the present invention. Even the source of the document 10 need not know the precise composition of the unique chemical concentrate unless the source verifies the authenticity of documents forensically. The manufacturer of the unique chemical concentrate need not know the identity of the end user, because it merely supplies the unique chemical concentrate to the manufacturer of the document 10. Further, possession of the unique chemical solution 24 and the complementary activating solution 28 is controlled. The unique chemical solution 24 is possessed by only those persons authorized by the source to manufacture the document 10. If the complementary activating solution 28 is used to verify the authenticity of the document 10, the complementary activating solution 28 is possessed by only those persons authorized by the source to verify the authenticity of the document 10. The security provided by the present invention is further enhanced by the fact that the technology in producing unique chemical concentrates is kept secret from the general public and is known only to a few commercial manufacturers. One such supplier of these unique chemical concentrates is Permion Technologies, Inc. located at 2288 Hunter Road, Kelowna, British Columbia, V1X7H5.

Figure 7:
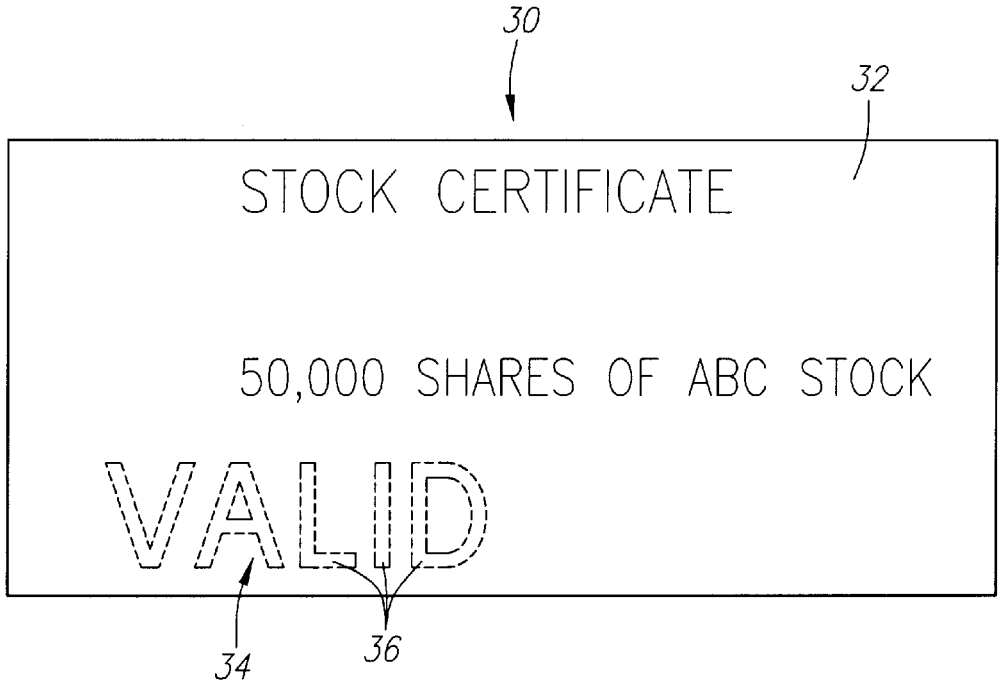
FIG. 7 is a top view of a counterfeit-resistant document according to another preferred embodiment of the present invention.

FIG. 7 depicts a counterfeit-resistant document 30 comprising a substrate 32 and a validation mark 34 according to another preferred embodiment of the present invention. The counterfeit-resistant document 30 is similar to the counterfeit-resistant document 10, with the exception that the unique chemical concentration is combined with any one or combination of a variety of inks instead of the alcohol/water solution to form a unique signature ink 36.

In one embodiment, the unique chemical concentration is combined with a non-security type of ink, such as an offset or flexographic ink, to form the unique signature ink 36. The unique signature ink 36 is applied to the substrate 32 with a standard printing process to form a validation mark 34 with informational value. The authenticity of the document 30 is verified in the same manner as described above with respect to the document 10.

In other embodiments, the unique chemical concentration is combined with a specially designed ink to form the unique signature ink 36, and applied to the substrate 32 in a manner that provides the document 30 with an additional security measure. The color of the ink is closely matched with the color of the substrate 32, and the unique signature ink 36 is applied as a very thin coating to the substrate 32 using a conventional printing process to form the validation mark 34. The validation mark 34 is latent in that the coating has more uniform directional reflective properties than that of the substrate 32 when the coating is dry. Further detailed information concerning the chemical composition of the ink used to form the validation mark 34 is disclosed in U.S. Pat. No. 5,695,220 issued to George K. Phillips, which is fully incorporated herein by reference.

The validation mark 34 is not readily ascertainable by the unaided eye at particular viewing angles. When the validation mark 34 is viewed at an angle approximately perpendicular to the surface of the substrate 32, the brightness of the substrate 32 is similar to the brightness of the unique signature ink, and the validation mark 34 is not readily ascertainable by the unaided eye. On the other hand, when the validation mark 34 is viewed at an angle different from that perpendicular to the surface of the substrate 32, the brightness of the substrate 32 is dissimilar to the brightness of the unique signature ink, and the validation mark 34 is readily ascertainable by the unaided eye. Further details concerning the latent characteristics of the validation mark 34 are disclosed in U.S. Pat. No. 5,695,220 issued to George K. Phillips, which has previously been incorporated herein by reference. The validation mark 34 preferably forms a validating word, such as "VALID" or "SAFE," as depicted in FIG. 7 to indicate the authenticity of the document 30.

The present invention of the document 30 is preferably practiced as follows. A unique chemical concentrate comprising the unique chemical identifying agent and the unique molecular code, which identify the source of a document 30, is selected, mixed with the latent ink 36, and applied to the document 30 to form the validation mark 34 as described above. When the source of the document 30 comes into possession of a document that is anticipated as being the document 30, the authenticity of that document is verified through a three-tiered process as follows. At the first tier, the unverified document is exposed to visual light and viewed at an angle different from the angle perpendicular to the document. If validation words, such as "VALID" or "SAFE," do not visually appear on the unverified document, the unverified document is confirmed as a counterfeit or replication of the original and valid document 30 and no further analysis of the bogus document is necessary. If validation words do appear on the unverified document, the authenticity of the document is partially verified. The authenticity of the partially verified document is fully verified, as described above with respect to the document 10, by applying the complementary activating solution 28 on the partially verified document 30 at the second tier, and by spectrographically analyzing or forensically analyzing the partially verified document at the third tier.

In alternative embodiments, UV dye is added to the ink to provide an additional security measure as described above with respect to the document 10. Like the document 10, any of the techniques described with respect to the document 30 above can be foregone or combined with the other techniques in any manner that satisfies the particular user's security needs.

As mentioned above, the unique chemical concentrate can be combined with other security type of inks, such as thermographic or photographic inks. The composition and method of using thermographic inks to form validation marks on documents is disclosed in pending application Ser. No. 08/602,243, entitled "Document Security System Having Thermographic Pantograph and Validation Mark," and filed by George K. Phillips on Feb. 16, 1996, which is fully incorporated herein by reference.

Figure 8:
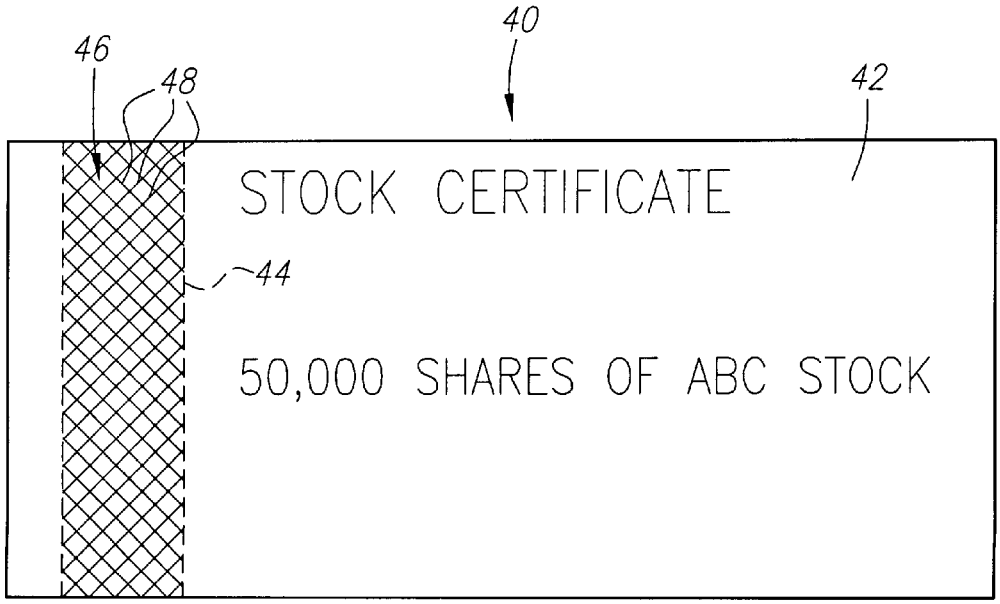
FIG. 8 is a top view of a counterfeit-resistant document according to still another preferred embodiment of the present invention.

FIG. 8 depicts a counterfeit-resistant document 40 comprising a substrate 42 and a validation mark 44 according to another preferred embodiment of the present invention.

The validation mark 44 comprises a set of relief markings 48 having a unique pattern 46. The unique pattern 46 formed by the relief markings 48 is not readily detected by the unaided eye, but under magnification reveals a magnified pattern, such as unique patterns 52, 54, 56, and 58 respectively depicted in FIGS. 9–12.

Figure 9:
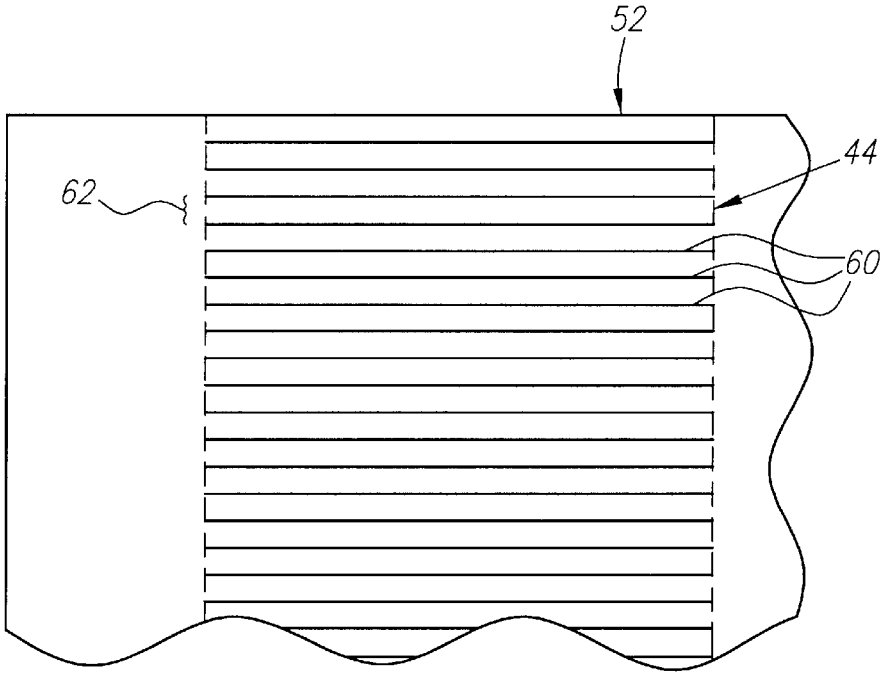
FIG. 9 is a top view of a first unique pattern that can be employed in the document of FIG. 8.
Figure 10:
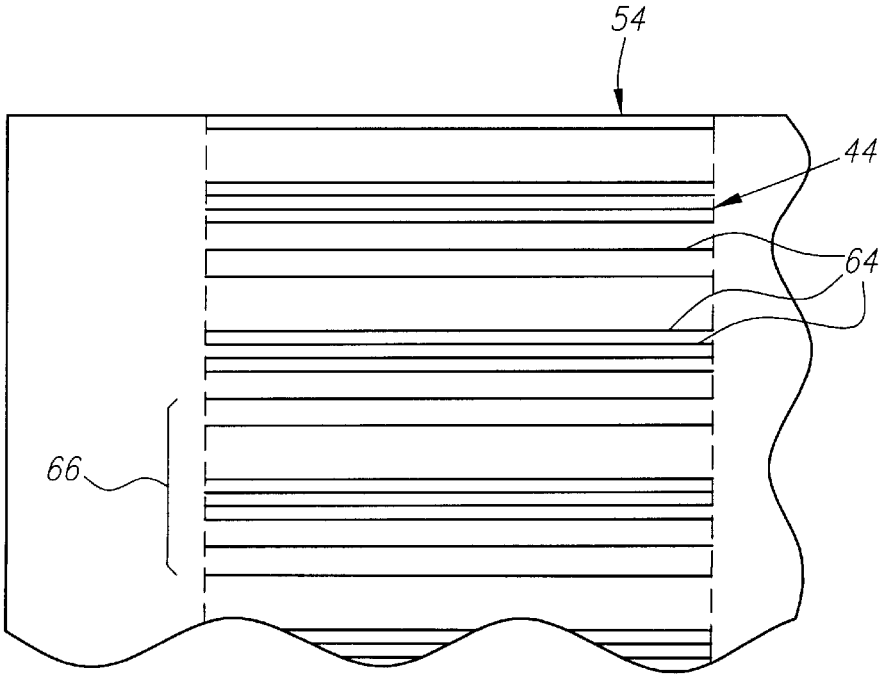
FIG. 10 is a top view of a second unique pattern that can be employed in the document of FIG. 8.

The unique pattern 52 shown magnified in FIG. 9 comprises a series of parallel rectilinear lines 60 that are equally spaced apart. The rectilinear lines 60 are perpendicular to the length of the validation mark 44. The uniqueness of the pattern 52 lies in a spacing size 62 between the rectilinear lines 60. The unique pattern 54 shown magnified in FIG. 10 comprises a series of parallel rectilinear lines 64 that are unequally spaced apart. The uniqueness of the pattern 54 lies in a cyclical combination 66 of the rectilinear lines 64.

Figure 11:
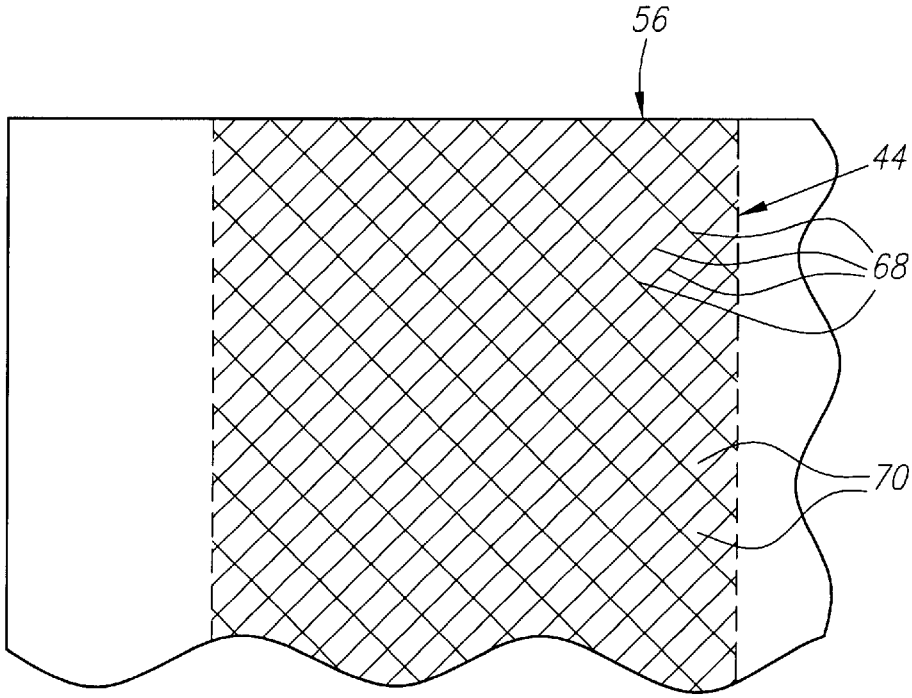
FIG. 11 is a top view of a third unique pattern that can be employed in the document of FIG. 9.
Figure 12:
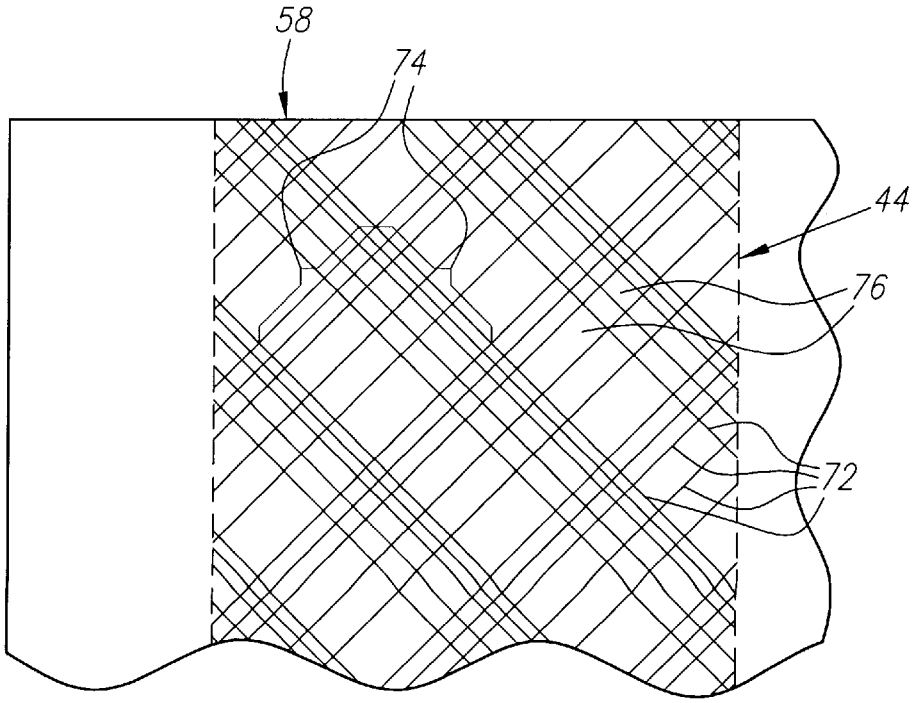
FIG. 12 is a top view of a fourth unique pattern that can be employed in the document of FIG. 10.

The unique pattern 56 shown magnified in FIG. 11 comprises a series of intersecting rectilinear lines 68 that are equally spaced apart in both directions. The uniqueness of the pattern 56 lies in the size of the rectangles 70 formed by the intersecting rectilinear lines 68. The unique pattern 58 shown magnified in FIG. 12 comprises a series of intersecting rectilinear lines 72 that are unequally spaced apart in both directions. The uniqueness of the pattern 58 lies in the cyclical combination 74 of the rectangles 76 formed by the intersecting rectilinear lines 72.

In alternative embodiments, the unique patterns shown in FIGS. 9–12 are angularly oriented with respect to the validation mark 44 in a variety of directions to provide angular uniqueness to the patterns. The unique patterns in which the relief markings 48 can be formed are not limited to the rectilinear lines shown in FIGS. 9–12 and can include any line or shape that is capable of identifying a source. For instance, the relief markings 46 can be created by forming an array of holes in the substrate resulting in a unique number of holes found in a given length or area of the validation mark 44. The more unique the pattern formed by the relief markings 48 are, the more security the validation mark 44 provides.

Figure 13:
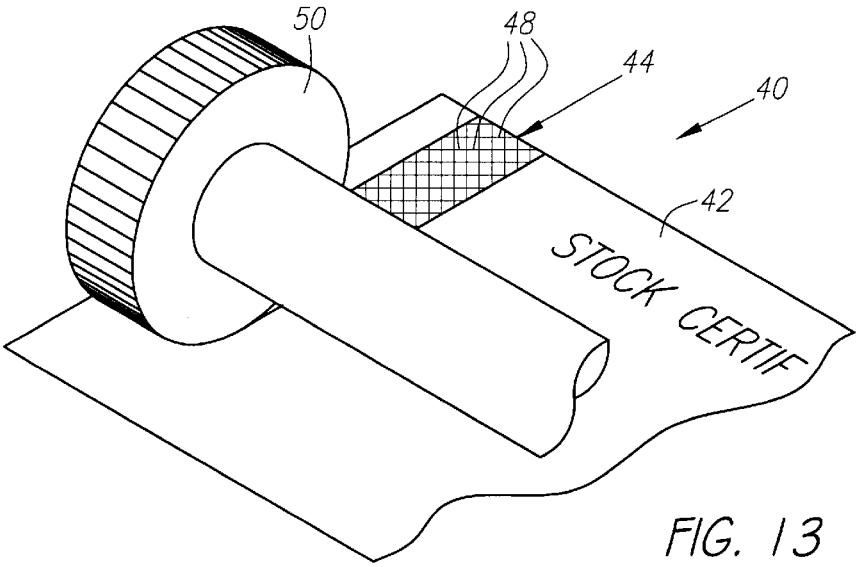
FIG. 13 is a perspective view depicting a preferred method of forming a validation mark on the document of FIG. 8.

As depicted in FIG. 13, a hardened application device, such as a pattern wheel 50, is employed to form the relief markings 48 on the substrate 42. The application of the unique pattern wheel 50 with sufficient pressure on the surface of the substrate 42 causes the relief markings 48 to form on the substrate 42. As shown in FIG. 13, the unique pattern, and in this case, unique pattern 56, is formed into the unique pattern wheel 50. As the unique pattern wheel 50 rolls across the substrate 42, relief markings 38 having a corresponding unique pattern 56 are formed onto the substrate 42 to create the validation mark 44.

Figure 14:
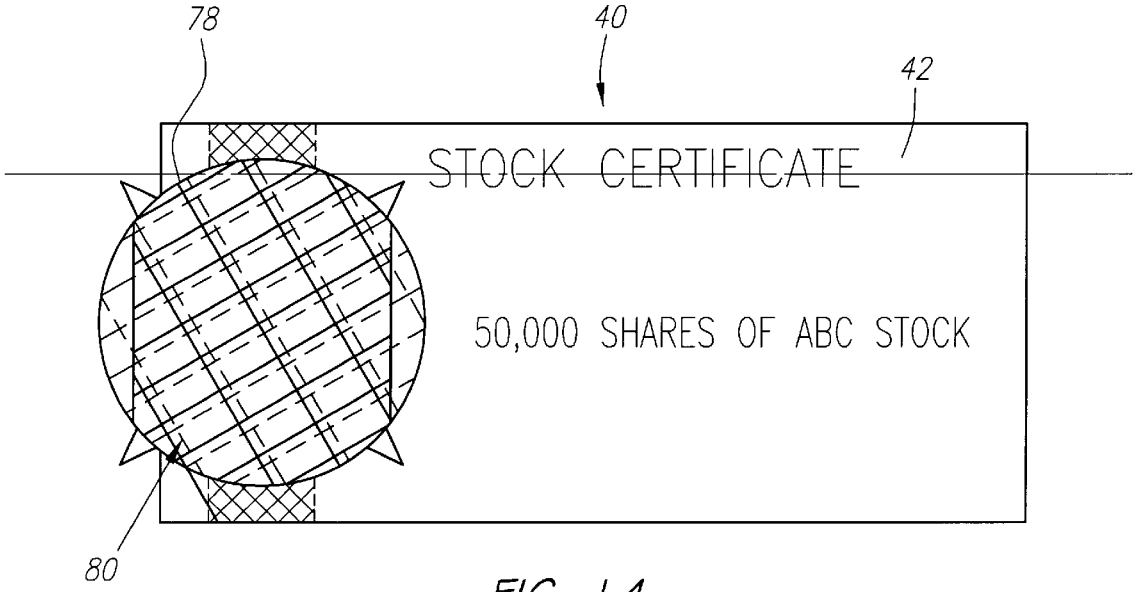
FIG. 14 is a top view depicting a preferred method of detecting a unique pattern on the validation mark of the document of FIG. 8, wherein a pattern formed by relief markings on a document match a reference pattern.
Figure 15:
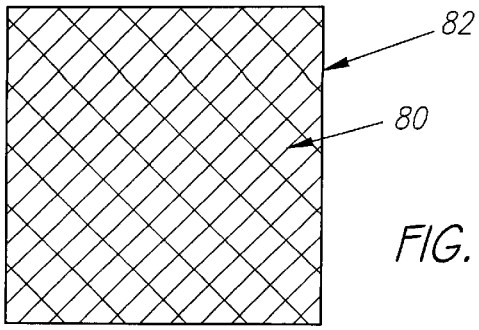
FIG. 15 is a top view of a reference pattern employed in an alternative preferred method of detecting a unique pattern on the validation mark of the document of FIG. 8.

As mentioned above, the unique pattern 46 formed on the document 40 is not readily detected by the unaided eye, but is rather detected by magnifying the validation mark 44. Preferably, a magnification loupe 78, as shown in FIG. 14, is employed to magnify the unique pattern 46. The magnification loupe 78 is customized in that markings are applied to the magnification loupe to form a reference pattern 80 (shown in dashed lines) thereon. The reference pattern 80 is larger than but proportional to the unique pattern 46. The size ratio between the reference pattern 80 and the unique pattern 56 is approximately equal to the magnification power of the magnification loupe 78, so that the magnified unique pattern 46 can be more easily compared to the reference pattern 80. Alternatively, as shown in FIG. 15, the reference pattern 80 is printed on a separate piece of paper 82 for comparison with the magnified unique pattern 56.

Figure 16:
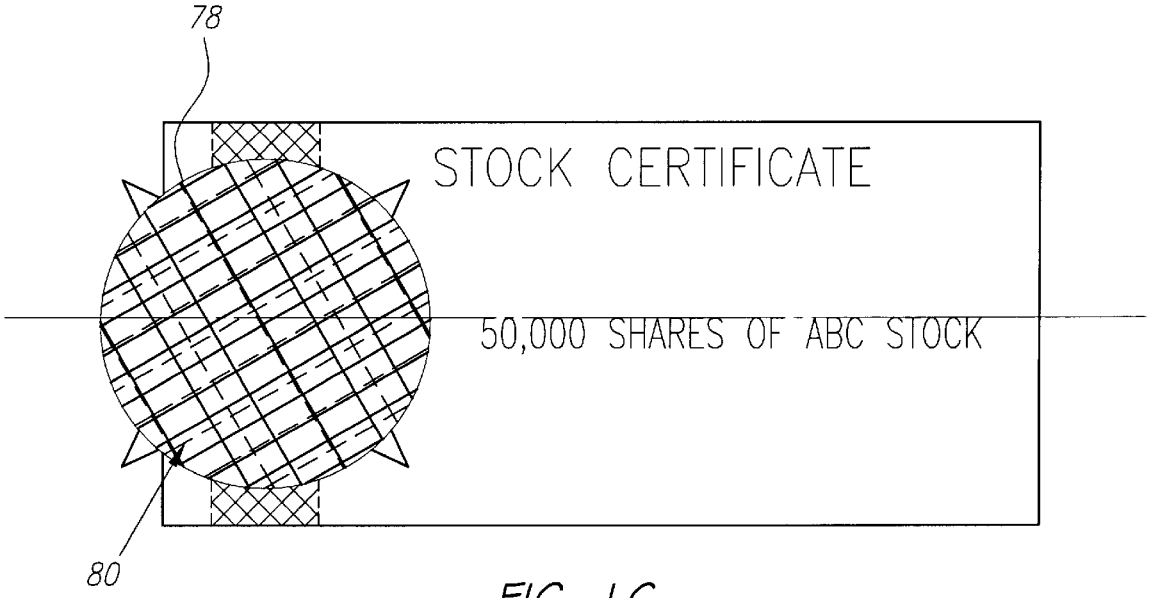
FIG. 16 is a top view depicting the preferred method of FIG. 14, wherein a pattern formed by relief markings on a document do not match a reference pattern.

The present invention of the document 40 is practiced as follows. A unique pattern 46, which identifies the source of a document 40 is selected. The relief markings 48 are formed onto the document 40 in accordance with the unique pattern 46 to form the validation mark 44 as described above. When the source of the document 40 comes into possession of a document that is anticipated as being the document 40, the authenticity of that document is verified as follows. The area of the document where the validation mark 44 is expected to be located is magnified with the magnification loupe 78 to expose any relief markings thereon as shown in FIG. 14. If relief markings exist, the pattern formed by the relief markings is compared to the reference pattern 80 formed on the magnification loupe 78, such as shown in FIG. 14, or a separate piece of paper 82, as shown in FIG. 15. A match between the pattern formed by the relief markings and the reference pattern 80, as depicted in FIGS. 14 and 15, indicates that the document originates from the anticipated source, confirming the document as the original and valid document 40. Conversely, a lack of relief markings, or a lack of a match between the pattern formed by the relief markings and the reference pattern 80, as depicted in FIG. 16, indicates that the document does not originate from the anticipated source, confirming the document as a counterfeit or replication of the original and valid document 40.

The validation mark 44 of the document 40 alternatively comprises a unique chemical signature such as that described with respect to the document 10. The unique chemical signature comprises a unique chemical identifying agent and unique molecular code and is applied to the validation mark 44 in the same manner as described with respect to FIG. 2, with the exception that the unique pattern wheel 50, rather than the standard pattern wheel 20, is used to impress the unique chemical solution 24 into the substrate 42 of the document 40.

If the validation mark 44 comprises a unique chemical signature, the present invention of the document 40 is practiced as follows. A unique pattern 46 and a unique chemical signature are selected, which identifies the source, and if applicable, other aspects of the document 40. The unique pattern 46 is formed on a unique pattern wheel 50, and the unique chemical signature is applied to the document 40 by employing the unique pattern wheel 50 to form the validation mark 44 as described above. When the source of the document 40 comes into possession of an unverified document that is anticipated as being the document 40, the authenticity of the unverified document is verified through a three-tiered process as follows.

At the first tier, the unverified document is analyzed to determine if it comprises any relief markings that match the reference pattern 80 in the manner described above. If the unverified document does not comprise relief markings, or the relief markings do not form a pattern that matches the reference pattern 80, the unverified document is confirmed as a counterfeit or replication of the original and valid document 40, and no further analysis of the bogus document is necessary. If the relief markings form a pattern that matches the reference pattern 80, the authenticity of unverified document is partially verified. The partially verified document is fully verified, as described above with respect to the document 10, by applying the complementary activating solution 28 on the partially verified document 40 at the second tier, and spectrographically or forensically analyzing the partially verified document at the third tier.

In alternative embodiments, UV dye is added to the ink to provide a four-tiered security measure. At the first tier, the authenticity of a document anticipated to be the original and valid document 10 is exposed to ultraviolet light. If the validation mark 14 does not visually appear under the ultraviolet light, the unverified document is confirmed as a counterfeit or replication of the original and valid document 10, and no further analysis of the bogus document is necessary. If the validation mark 14 visually appears, the authenticity of the unverified document is partially verified. The partially verified document can be fully verified, as described above, by analyzing any relief markings on the partially verified document at the second tier, applying the complementary activating solution 28 to the partially verified document at the third tier, and spectrographically or forensically analyzing the partially verified document at the fourth tier as described above.

Like the documents 10 and 30, any of the techniques described with respect to the document 40 above can be foregone or combined with the other techniques in any manner that satisfies the particular user's security needs.

While embodiments and applications of this invention have been shown and described, it would be apparent to those skilled in the art that many more modifications are possible without departing from the inventive concepts herein.

The invention, therefore is not to be restricted except in the spirit of the appended claims.

What is claimed is:

1. A counterfeit-resistant document, comprising:

a substrate; and a validation mark disposed on said substrate, said validation mark comprising relief markings, said relief markings formed in a unique pattern specific to an identifying aspect of said document.

2. A counterfeit-resistant document, comprising:

a substrate; and a validation mark disposed on said substrate, said validation mark comprising relief markings, said relief markings formed in a unique pattern specific to a source of said document.

3. A counterfeit-resistant document, comprising:

a substrate; and a validation mark disposed on said substrate, said validation mark comprising relief markings, said relief markings formed in a unique pattern specific to a particular type of said document.

4. The counterfeit-resistant document of claim 1, wherein said unique pattern cannot be readily ascertained.

5. The counterfeit-resistant document of claim 1, wherein said unique relief pattern comprises a plurality of parallel rectilinear markings.

6. The counterfeit-resistant document of claim 1, wherein said unique relief pattern comprises a plurality of intersecting rectilinear markings.

7. The counterfeit-resistant document of claim 1, further comprising a second validation mark, said second validation mark comprising a unique chemical signature specific to an identifying aspect of said document.

8. The counterfeit-resistant document of claim 7, wherein said unique chemical signature comprises a chemical identifying agent and a unique molecular code.

9. The counterfeit-resistant document of claim 1, wherein said validation mark further comprises a unique chemical signature specific to an identifying aspect of said document.

10. The counterfeit-resistant document of claim 9, wherein said unique chemical signature comprises a unique chemical identifying agent and a unique molecular code.

11. The counterfeit-resistant document of claim 2, wherein said validation mark further comprises a unique chemical signature that identifies said source.

12. A method of verifying a document, the method comprising the steps:

selecting a unique pattern specific to an identifying aspect of said document;

forming relief markings on said document according to said unique pattern; and detecting said unique pattern on said document.

13. A method of verifying a document, the method comprising the steps:

selecting a unique pattern specific to a source of said document;

forming relief markings on said document according to said unique pattern; and detecting said unique pattern on said document to identify said source of said document.

14. The method of claim 12, wherein said unique pattern detection step comprises magnifying said unique pattern.

15. The method of claim 14, wherein said unique pattern identification step further comprises applying reference marks to a magnification loupe, magnifying said unique pattern with said magnification loupe, and comparing said unique pattern to said reference marks.

16. The method of claim 14, wherein said unique pattern detection step further comprises comparing said unique pattern to a reference pattern.

17. A method of verifying a document, the method comprising the steps:

selecting a unique pattern specific to an identifying aspect of said document;

forming said unique pattern onto a pattern wheel;

forming relief markings on said document according to said unique pattern by rolling said pattern wheel over said document; and detecting said unique pattern on said document.

18. The method of claim 12, further comprising the steps:

selecting a unique chemical signature;

applying said unique chemical signature to said document; and detecting said unique chemical signature on said document.

19. A method of verifying a document, the method comprising the steps:

selecting a unique pattern and a unique chemical signature both specific to a source of said document;

forming relief markings on said document according to said unique pattern;

applying said unique chemical signature to said document; and detecting said unique pattern and said unique chemical signature on said document to identify said source of said document.

20. The method of claim 14, further comprising:

selecting a unique chemical signature, said unique chemical signature comprising a chemical identifying agent and a unique molecular code;

applying said unique chemical signature to said document; and detecting said unique chemical signature on said document.

21. A method of verifying a document, the method comprising the steps:

selecting a unique pattern and a unique chemical signature, both specific to a source of said document, said unique chemical signature comprising a unique chemical identifying agent and a unique molecular code, wherein said unique chemical identifying agent reacts to a complementary chemical activator; forming relief markings on said document according to said unique pattern;

applying said unique chemical signature to said document;

detecting said unique pattern by magnifying said unique pattern;

detecting said unique chemical signature by applying said complementary chemical activator to said unique chemical identifying agent.

22. The method of claim 21, wherein said unique chemical signature detection step further comprises spectrographically analyzing said unique molecular code.

23. The method of claim 21, wherein said unique chemical signature detection step further comprises forensically analyzing said unique molecular code.

24. A method of verifying a document, the method comprising the steps:

selecting a unique pattern and a unique chemical signature, both specific to a source of said document, said unique chemical signature comprising a chemical identifying agent and a unique molecular code;

combining said chemical identifying agent and said unique molecular code with a liquid to form a unique chemical solution;

wherein said unique chemical signature application step forming relief markings on said document according to said unique pattern while pressing said unique chemical solution into said document; and detecting said unique pattern and said unique chemical signature on said document.

25. The method of claim 24, further comprising the steps: combining UV dye with said unique chemical solution; and exposing said document to UV light to detect said UV dye.

26. The counterfeit-resistant document of claim 8, wherein said chemical identifying agent is unique.

27. The counterfeit-resistant document of claim 20, wherein said chemical identifying agent is unique.

28. The counterfeit-resistant document of claim 24, wherein said chemical identifying agent is unique.

* * * * *